US005366230A

United States Patent [19]

Sanquinetti-Trigo

[11] Patent Number: 5,366,230

[45] Date of Patent: Nov. 22, 1994

[54] DART GAME WITH DART HIT VERSUS NON-DART HIT IMPACT DISCRIMINATION

[76] Inventor: Jorge J. Sanquinetti-Trigo, 600 S. Cloverdale Ave. #406, Los Angeles, Calif. 90036

[21] Appl. No.: 63,219

[22] Filed: May 18, 1993

[51] Int. Cl.[5] ..... F41J 3/00; F41J 5/052

[52] U.S. Cl. ..... 273/371; 273/374

[58] Field of Search ..... 273/371, 374, 376, 377

[56] References Cited

U.S. PATENT DOCUMENTS

| | | | |
|---|---|---|---|
| 4,561,660 | 12/1985 | Zammuto | 273/376 |
| 4,768,789 | 9/1988 | Clark | 273/371 |
| 4,793,618 | 12/1988 | Tillery et al. | 273/376 |
| 4,824,121 | 4/1989 | Beall et al. | 273/376 |
| 5,156,643 | 10/1992 | Grubek | 273/376 |

*Primary Examiner*—Jessica J. Harrison

*Attorney, Agent, or Firm*—McAndrews, Held & Malloy

[57] ABSTRACT

A dart game is shown having an automatic player change feature that is implemented by software wherein the software discriminates between dart hit impacts and non-dart hit impacts on the scoring segments of a dart head. The dart game includes a controller that determines the occurrence of an event representing the actuation of a scoring segment of the dart head. The controller determines whether a scoring segment is actuated by a dart hit impact or a non-dart hit impact by monitoring the time that the scoring segment remains actuated. If the scoring segment is actuated for only a short, but stable period of time, the impact is determined to be a dart hit. However, if the scoring segment is actuated for a longer period of time, the impact is determined to be a non-dart hit impact. The controller is responsive to the occurrence of a predetermined number of dart hit impacts and/or detected missed darts to automatically generate a player change signal to eliminate the need for a player to manually actuate a switch to signal the start of the next player's turn.

12 Claims, 4 Drawing Sheets

DART GAME WITH DART HIT VERSUS NON-DART HIT IMPACT DISCRIMINATION

TECHNICAL FIELD

The present invention is directed to a dart game, and more particularly to a dart game with dart hit versus non-dart hit impact discrimination and a software implemented automatic player change feature.

BACKGROUND OF THE INVENTION

Known dart games have included a microprocessor-controlled dart head having a number of scoring segments. Each of the scoring segments is actuatable by an impact thereon to generate a signal. One such known dart game includes software to determine whether an actuated scoring segment represents a stuck segment by determining whether the segment has remained in a continuously actuated state for a given period of time, such as 700–800 msecs. In this dart game, the microcontroller of the dart head transmits to a main microcontroller a code representing the identity of an actuated segment and an indication of whether the actuated segment is a stuck segment or not. The main microcontroller is then responsive to the information transmitted from the dart head microcontroller for controlling the scoring of the dart game. This known dart game also includes a missed dart detector switch mounted on the dart head. The missed dart detector is responsive to vibration of the dart head by a dart that does not hit a scoring segment, but causes an impact on or vibration of the dart head. The dart head microcontroller is responsive to the actuation of the missed dart detector to transmit a code representing a missed dart, i.e., a dart that is thrown but has missed hitting a scoring segment, to the main microcontroller. The main microcontroller of the dart game is responsive to a total of three dart hits and/or missed darts to transmit a signal to light a player change lamp in order to provide an indication to the players that it is the next player's turn. In order to proceed with the game, a player has to manually actuate a player change switch mounted on the housing of the dart game. In response to the actuation of the player change switch, the game is not responsive to impacts on the dart head for a period of six seconds, for example, to enable the player to remove his darts from the dart head without causing a dart hit to be recognized by the game. After this time period expires, the main microprocessor controller causes a "throw dart" lamp to be lit to indicate that it is ready to score the next player's dart hits.

Other known dart games have included an infrared sensor or the like to detect the proximity of a player to the dart head. Such dart games are responsive to a player's proximity to the game as detected by the sensor by ignoring impacts on the dart head, the game assuming that any impacts which occur during the time that a player is detected in proximity to the sensor are the result of a player removing his darts from the dart head. These known dart games are also responsive to the player proximity sensor to effect an automatic player change feature. Although these games do not require a player to manually actuate a switch in order for the game to recognize a change in the player throwing the darts, the operation of this type of automatic player change feature has been found to malfunction fairly frequently, causing problems in scoring. Further, the addition of the player proximity sensor adds to the cost of the dart game.

SUMMARY OF THE INVENTION

In accordance with the present invention, the disadvantages of prior dart games, as discussed above, have been overcome. The dart game of the present invention includes a software implemented automatic player change feature with the ability to discriminate between dart hit impacts and non-dart hit impacts such as a finger touch on the dart head so as to provide a dart game that accurately scores a player's dart hits.

More particularly, the dart game of the present invention includes a dart head having a plurality of scoring segments, each of which is actuatable by an impact thereon, including a dart hit impact and a non-dart hit impact. The dart game also includes a microcontroller that determines the occurrence of an event representing the actuation of a scoring segment. In response to a scoring segment actuation event determination, the controller further determines whether the actuated scoring segment was actuated by a dart hit impact, which should contribute to a player's score, or by a non-dart hit impact, which should be ignored with regard to the player's score. The microcontroller discriminates between dart hit impacts and non-dart hit impacts by determining whether a scoring segment remains actuated for a predetermined period of time. If the actuated scoring segment does remain actuated for that predetermined period of time, the dart hit discrimination means determines that the scoring segment was actuated by a non-dart hit impact. Because dart hit impacts have been found to actuate the scoring segment for a relatively short period of time, if the actuated scoring segment remains actuated for a predetermined period of time of at least 200–300 milliseconds, the dart hit discrimination means determines that the scoring segment was actuated by a non-dart hit impact.

In accordance with the present invention, the dart head also includes a missed dart detection apparatus associated therewith, and actuatable by vibration of the dart head such as caused by a dart hitting the cabinet housing the game. The microcontroller further includes means for determining the occurrence of an event representing the actuation of the missed dart detection apparatus, and in response thereto determines whether the missed dart detection apparatus is functioning properly or not. The microcontroller also includes means for determining the occurrence of a predetermined total number of dart hit impacts and missed darts detected by a properly-functioning missed dart detection apparatus to automatically generate a player change signal.

The automatic player change function of the present invention eliminates the need for a player to manually actuate a player change switch in order to signal the dart game that subsequent dart hits on the dart head should be attributable to the next player. Further, because the dart game of the present invention can discriminate between dart hit impacts and non-dart hit impacts, when a player touches the dart head while removing his darts the dart game will not interpret a scoring segment actuated by a finger-touch as a dart hit attributable to the next player.

These and other objects, advantages, and novel features of the present invention, as well as details of an illustrated embodiment thereof, will be more fully understood from the following description and from the drawing.

DESCRIPTION OF THE PREFERRED EMBODIMENT

Figure 1:
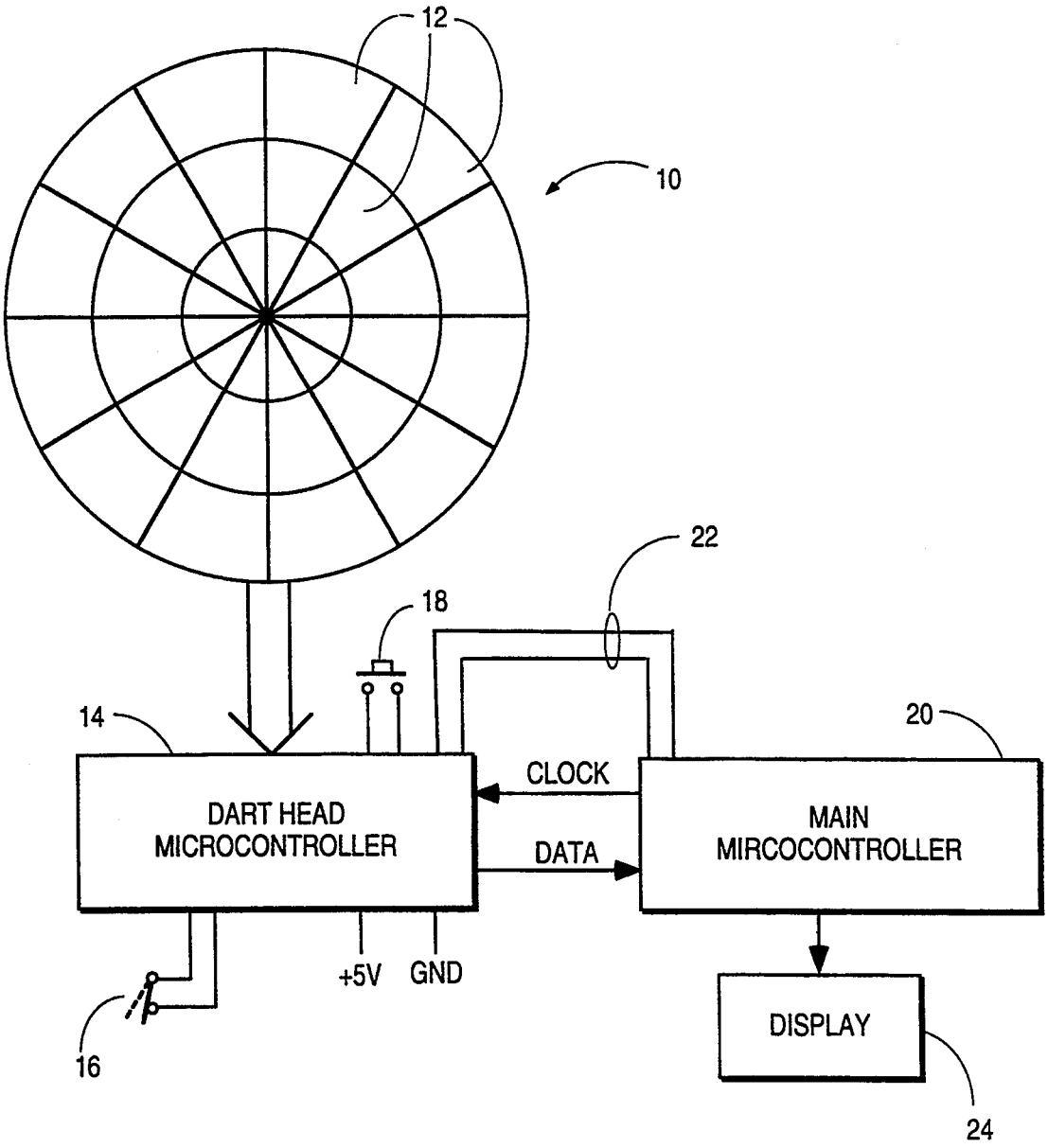
FIG. 1 is a block diagram illustrating a dart game in accordance with the present invention.

The dart game of the present invention as shown in FIG. 1 includes a conventional dart head 10 having a number of scoring segments 12. Each of the scoring segments 12 is actuated by an impact thereon to close a switch associated with the segment. The scoring segment switches form a switch matrix that is coupled to a dart head microcontroller 14. The dart head microcontroller 14 scans the switch matrix of the dart head 10; identifies any actuated scoring segment and determines whether the actuated segment was actuated by a dart hit impact or a non-dart hit impact, such as a finger-touch. The dart head microcontroller 14 transmits to a main microcontroller 20 a code representing the identity of an actuated scoring segment 12 and a designation of whether the segment was actuated by a dart hit or not. The dart head microcontroller 14 also includes a missed dart detector switch 16 which is in a normally closed position but opens in response to vibrations of the dart head 10 such as caused by a dart that misses a scoring segment but bounces off of the front, upper portion of a cabinet housing the dart head 10. In response to a detected missed dart, the dart head microcontroller 14 transmits a code representative thereof to the main microcontroller 20. The dart head microcontroller 14 monitors the total number of dart hits and missed darts, and in response to a total number of three, the microcontroller 14 couples an ENTER signal, representing that a change in players is to occur, on lines 22 to the main microcontroller 20. A manually-actuatable player change switch 18 is also provided and coupled to the dart head microcontroller 14 to allow a player to actuate the switch 18 to signal that a change in players is to occur in the event that a player throws a dart that misses the dart head 10 and the dart game cabinet so that neither a scoring segment 12 or the missed dart detector 16 is actuated. The main microcontroller 20 is responsive to the information transmitted from the dart head microcontroller 14 to accurately score each player's dart hits, the player's score being depicted on a display 24.

Figure 2A:
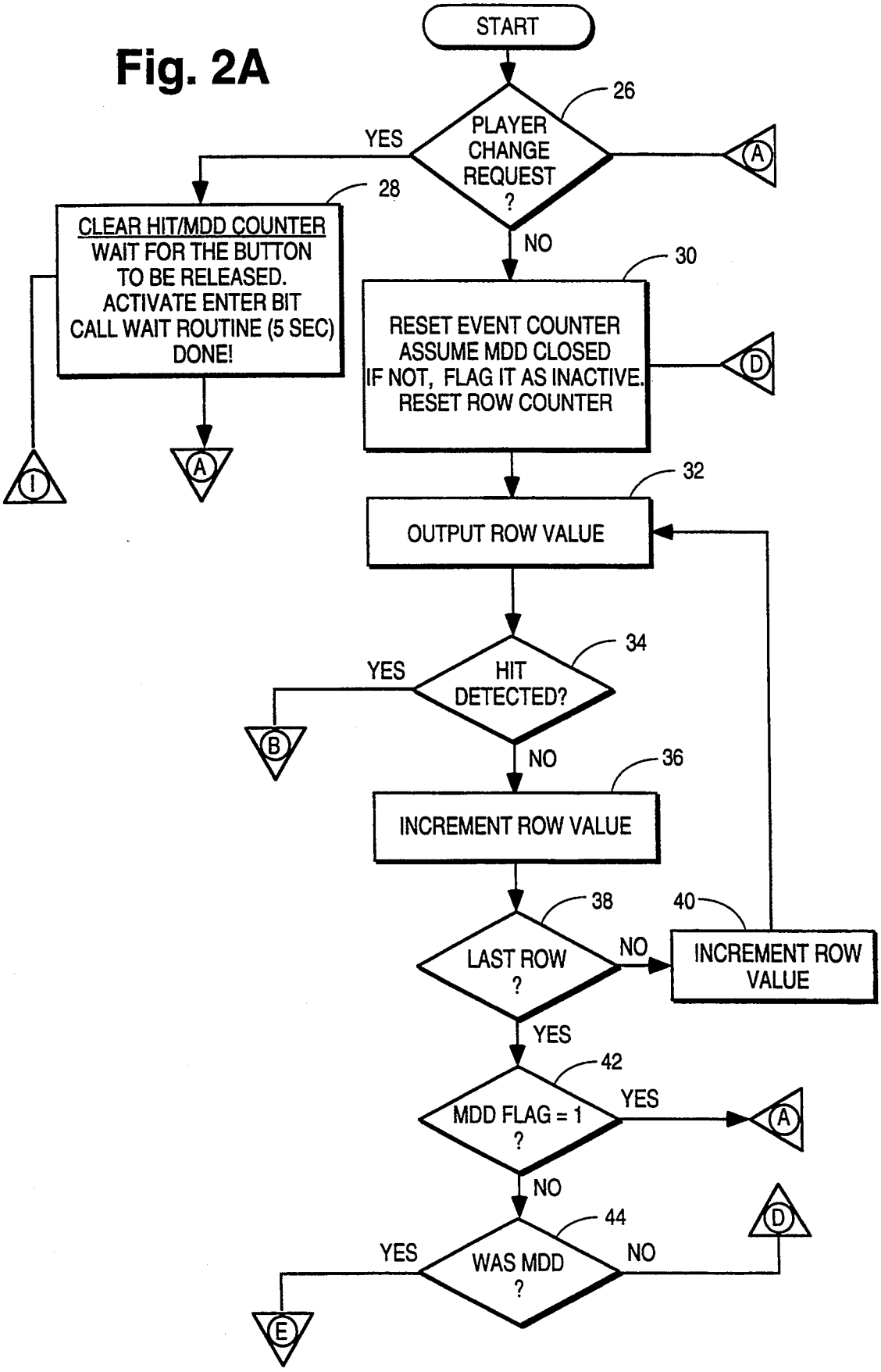
FIGS. 2A–2C form a flow chart illustrating the dart head microcontroller operating software routine of the present invention.
Figure 2B:
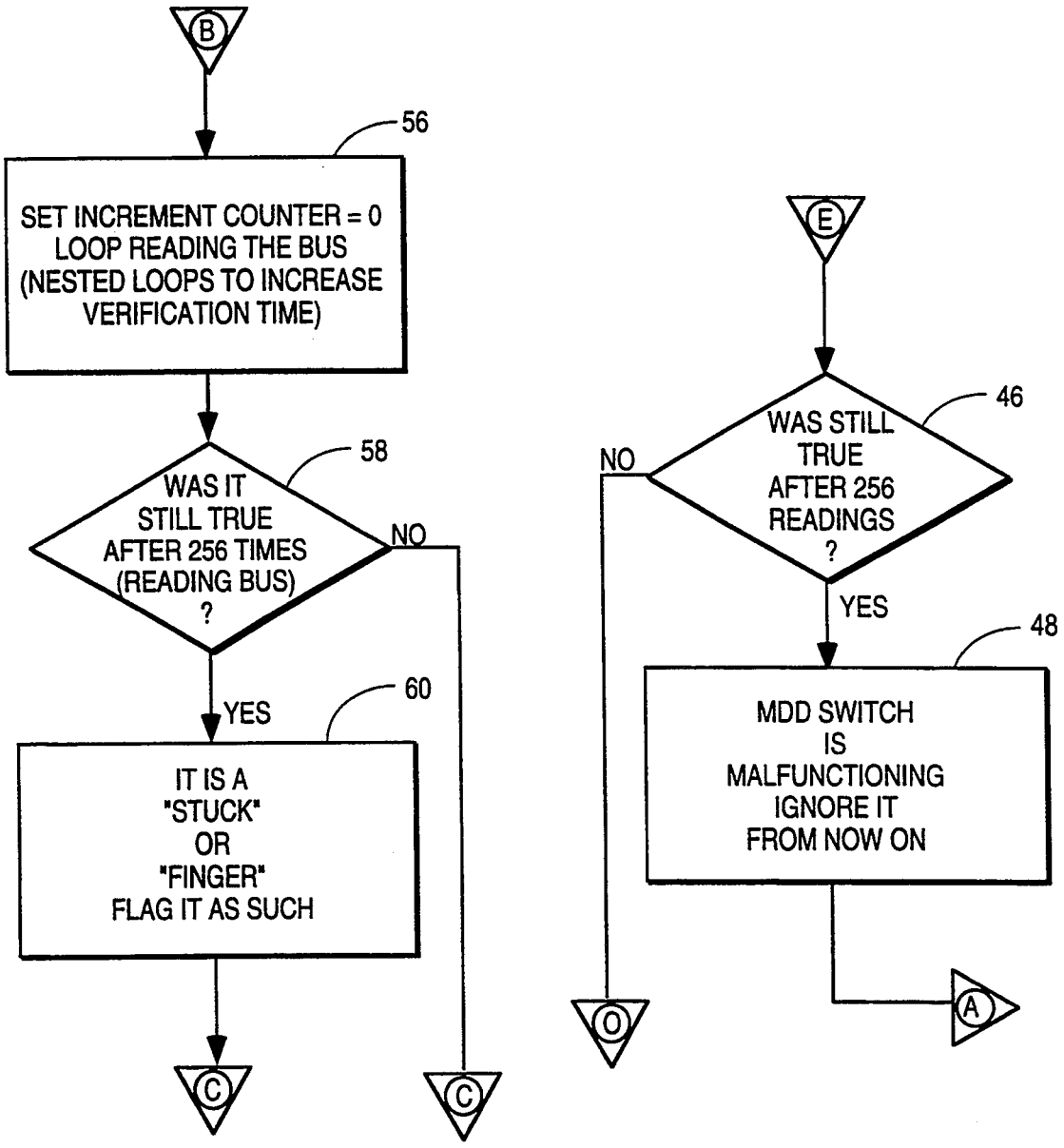
Figure 2C:
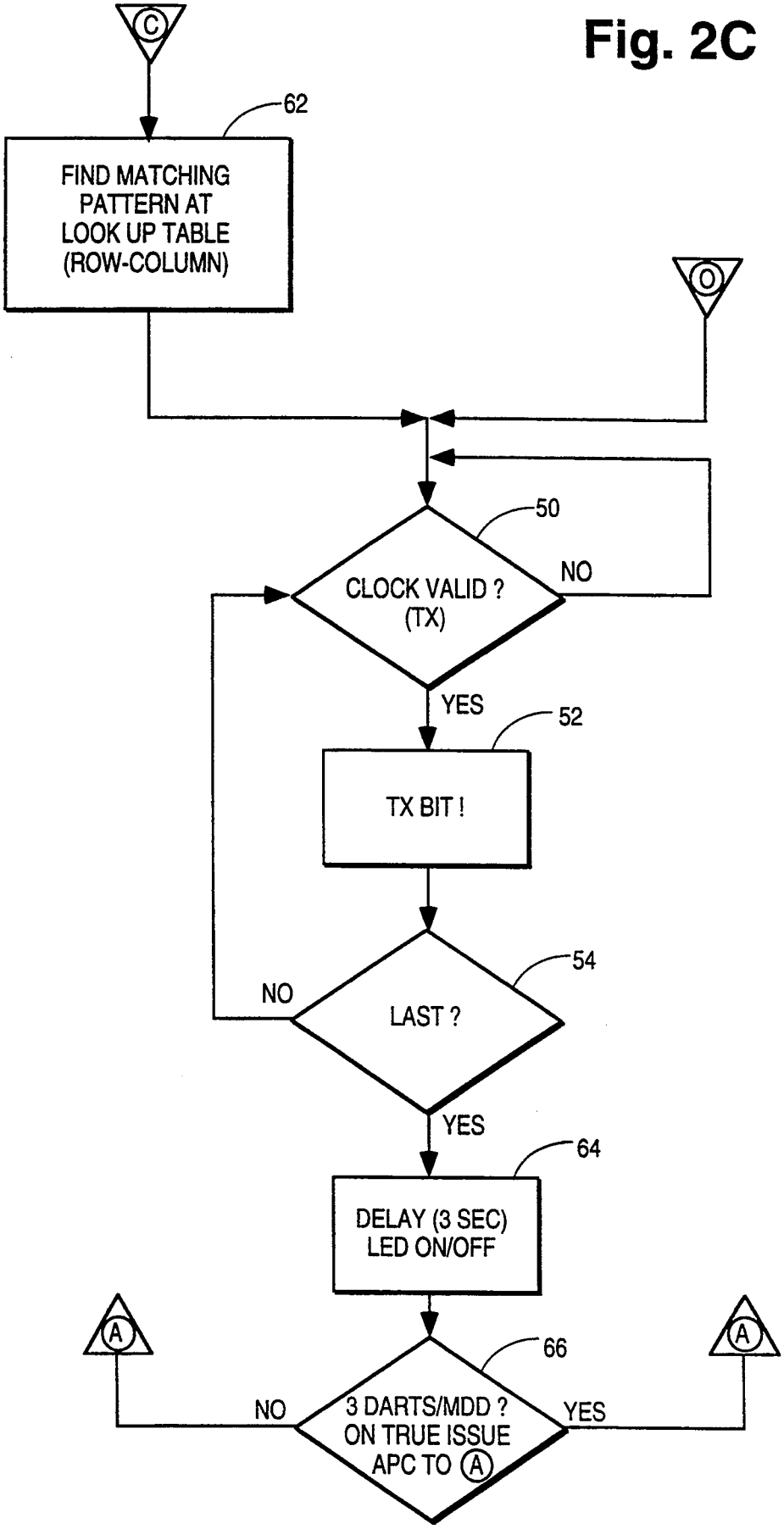

FIGS. 2A–C illustrate the software routine according to which the dart head microcontroller 14 operates. It is noted that the dart head microcontroller 14 may be an 8749AH microcontroller or the like, and includes a read-only memory for storing the software routine according to which the microcontroller operates. The microcontroller 14 also includes a battery backed-up RAM used for data manipulation and temporary data storage. As shown in FIG. 2A, at the start of its operation, the dart head microcontroller 14 determines at a block 26 whether a player change has been requested or not. A player change will be requested in response to actuation of the switch 18 or in response to the microcontroller determining that three dart hits and/or missed darts have been detected, as discussed below. If a player change has been requested, the microcontroller 14 proceeds to block 28. At block 28 the microcontroller 14 clears a dart hit/missed dart detector counter by resetting the counter to 2. Thereafter, the microcontroller 14 waits until the switch 18 has been released, and thereafter activates an "ENTER" bit which is transmitted to the main microcontroller 20 via lines 22. After activating the ENTER bit which signals the main microcontroller 20 that a player change is to occur, the microcontroller waits at block 28 for approximately five seconds. This five-second waiting period is provided so that the microcontroller 14 will not be responsive to the actuation of a scoring segment by a player touching the segment when removing his darts from the dart head 10. If a player does not remove his darts from the dart head 10 within the five seconds, the microcontroller 14 distinguishes non-dart hit impacts, such as finger-touches, on the dart head 10 from actual dart hit impacts so as to prevent a player's finger-touch that actuates a scoring segment from being interpreted as a dart hit, as discussed below.

If the microcontroller 14 determines at block 26 that a player change has not been requested, the microcontroller 14 proceeds to block 30 to reset an event counter. The event counter keeps track of the number of times that a closed scoring segment switch has been detected and is used to distinguish a dart hit from a finger impact or noise on the dart head 10. At block 30 the microcontroller checks the missed dart detector switch 16, and if the switch 16 is not closed, the microcontroller 14 flags the switch 16 as inactive, since at this point in the operation, if the missed dart detector switch 16 is operating properly, the switch 16 should be closed. The microcontroller 14 also resets the row counter at block 30 so as to initialize the row counter for the scanning of the scoring segment switch matrix. At a block 32, the microcontroller 14 outputs a row value and at block 34 determines whether any column within that row has a non-zero value therein representing an actuated scoring segment 12. If an actuated scoring segment 12 is not detected at block 34, the microcontroller 14 proceeds to block 36 to increment the row value of the scoring segment switch matrix. Thereafter, the microcontroller 14 proceeds to block 38 to determine whether the last row of the switch matrix has been checked. If not, the microcontroller 14 increments the row value at block 40 and returns to block 34 to determine whether any column in the next row has a non-zero value indicating an actuated scoring segment.

If the microcontroller 14 does not detect an actuated scoring segment during the scan of the scoring segment switch matrix, the microcontroller proceeds from block 38 to block 42 to determine whether the missed dart detector flag indicates that the detector 16 is inactive or not. If the microcontroller 14 determines that the missed dart detector switch 16 is inactive, the microcontroller proceeds back to block 26. If, however, the missed dart detector switch 16 is active, the microcontroller 14 proceeds to block 44 to determine whether the missed dart detector switch 16 is open or not. If the missed dart detector switch is closed, the microcontroller 14 proceeds back to block 30 to initialize the system for another scan or the scoring segment switch matrix. If, however, the missed dart detector switch 16 is open, the microcontroller 14 proceeds from block 44 to block 46. At block 46 the microcontroller 14 determines whether the missed dart detector switch is still open after reading the switch 256 times, and if so, the microprocessor proceeds to block 48 wherein the microcontroller 14 determines that the missed dart detector switch is malfunctioning and should be ignored.

From block 48 the microcontroller proceeds back to block 26. However, if after 256 readings, the missed dart detector switch 16 is no longer open, the microcontroller 14 proceeds to a block 50 in order to synchronize the transmission of a code representing a detected missed dart to the main microcontroller 20. When the microcontroller 14 determines that it is the correct time to transmit a bit of the event code, the microprocessor proceeds to block 52 to transmit one bit of the code to the main microcontroller 20. The microcontroller 14 continues to transmit the bits of the code until it detects that the last bit has been transmitted at block 54.

If during the scan of the scoring segment switch matrix the microcontroller 14 determines that a scoring segment has been actuated at block 34, the microcontroller proceeds to block 56, shown in FIG. 2B. At block 56, the microcontroller 14 sets an increment counter to zero and begins a loop to read the scoring segment switch matrix bus. At a block 58, the microcontroller 14 determines whether the activated switch segment is still closed after 256 readings, which represents a predetermined time period of between approximately 200–300 msec. A true dart hit impact on the dart head 10 will close the switch associated with a scoring segment for a short period of time that is less than 300 msec. Therefore, if the activated switch segment is determined to still be closed after 300 msec., the microcontroller proceeds to block 60 to flag the activated switch segment as a stuck segment, or a finger-impacted segment. Thereafter, the microcontroller proceeds to block 62 to find the code representing the identity of the actuated scoring segment 12 from a look-up table. At block 62, the microcontroller also sets one bit of the code to designate whether the actuated segment was actuated by a detected dart hit or a non-dart hit impact. Thereafter, the microcontroller proceeds to blocks 50, 52, and 54 to transmit the code representing the actuated scoring segment to the main microcontroller 20.

After the last bit of a code has been transmitted to the main microcontroller 20, as determined by the microcontroller 14 at block 54, the microcontroller 14 proceeds to block 64. At block 64, the microcontroller 14 waits for three seconds and turns an LED on and off to provide a communication transmission indication. At block 64, the microcontroller 14 also decrements the hit/missed dart detector counter if the code transmitted to the microcontroller 20 indicates either a missed dart or a dart hit. Thereafter, the microcontroller proceeds to block 66 to determine whether the hit/missed dart detector counter has been decremented to zero, indicating a total of three dart hits and/or missed darts. If the hit/missed dart detector counter has been decremented to zero, the microcontroller issues a player change request and proceeds to block 26 and from 26 to block 28 to effect an automatic player change. If, however, three dart hits and/or missed darts have not been detected, the microcontroller proceeds to block 26 without issuing the player change request.

Details of the software illustrated in the flow chart of FIGS. 2A–C are provided by the following code:

```
Galaxy Series Target Hit/Auto Player Change - Vers. 2.20 Rev B.
Copyright 1992 C. A. Robinson & Co. Inc.
All rights reserved.

;
strt_run:
;
;
            .org h'000
;
;
read_all:
;
;
            jni chnge_pl                ;If player change is req. proceed.
;
            mov r4,#h'00                ;MDD event counter to zero.
;
            mov r5,#h'00                ;Missing dart det. closed (L) mask.
;
            jnt0 scan_mtx               ;If closed, scan.
;
            mov r5,#h'ff                ;Ignore MDDs for now.
;
scan_mtx:                               ;Lets scan the mtx.
;
;
            mov r3,#h'00                ;Table pointer for Accumulator.
;
            mov r7,#h'08                ;Loop limit for Port 2.
            mov r6,#h'fe                ;Initial count for both ports.
;
pri_loop:   mov a, r6                   ;Load current col. add. into Acc.
            outl p2, a                  ;Latch it to Port 2.
            rl a                        ;Rotate it 1 bit to the left.
            mov r6, a                   ;Save it for next col. scan.
;
            ins a, bus                  ;Read the row's return.
            cpl a                       ;Complement it to obtain row #.
            jnz debounce                ;If non zero, there was a hit.
;
            mov a, r3                   ;Load table pointer into Acc.
            add a,#d'8                  ;Add 8 to it.
            mov r3, a                   ;Save new value as a pointer.
            djnz r7, pri_loop           ;Decrement loop counter.
```

-continued

Galaxy Series Target Hit/Auto Player Change - Vers. 2.20 Rev B.
Copyright 1992 C. A. Robinson & Co. Inc.
All rights reserved.

```
;
            orl p2,#h'ff                ;Reset the Port 2 to FFh.
            mov r7,#h'03                ;Set count for Port 1.
;
sec_loop:   mov a, r6                   ;Load current col. add. into Acc.
            outl p1, a                  ;Latch it to Port 1.
            rl a                        ;Rotate it 1 bit to the left.
            mov r6, a                   ;Save it for next col. scan.
;
            ins a, bus                  ;Read the row's return.
            cpl a                       ;. . . etc, etc.
            jnz debounce                ;If non zero, there was a hit.
;
            mov a, r3                   ;Load table pointer into Acc.
            add a,#d'8                  ;Add 8 to it.
            mov r3, a                   ;Save new value as a pointer.
            djnz r7, sec_loop           ;Decrement loop counter.
;
            orl p1,#h'ff                ;Reset port 1.
;
            mov a, r5                   ;Check MDD mask.
            jnz read_all                ;If (H) at start ignore.
;
            jt0 wasa_mdd                ;If not, check for MDD (H).
            jmp read_all                ;If (L) return.
;
wasa_mdd:   inc r4                      ;Otherwise increment event counter.
            mov a, r4
            xrl a,#d'5                  ;Check it happens at least 5 times.
            j2 mdd_conf                 ;If so confirm it.
            jmp scan_mtx                ;Otherwise assume it was noise.
;
mdd_conf:   jmp itis_mdd                ;Validate a true MDD.
;
;
debounce:                               ;Check for a valid hit.
;
;
            mov r6,#h'00                ;Incremental counter to 0.
            mov r4, a                   ;Save the native condition.
;
            mov r7,#h'ff                ;Prepare to read the bus a few times.
itis_hit:   ins a, bus                  ;Read it
            cpl a                       ;Complement it.
            xrl a, r4                   ;Xor it with itself.
            jnz loop_hit                ;If F. loop down there.
;
            inc r6                      ;Inc. the event counter.
;
            mov r5,#h'20                ;Do nothing for a while. (40)
lopng_hr:   djnz r5, lopng_hr
;
loop_hit:   djnz r7, itis_hit           ;Check for 256 ocurrences.
;
            mov a, r6                   ;Test Reg. 6.
            anl a,#h'80                 ;And it to see if it happens many tms.
            jnz dead_hit                ;If so it is stuck.
;
            jmp chk_r2r3                ;Otherwise it is OK.
;
dead_hit:   mov r7,#h'04                ;Stuck Mask T.
            inc r0
            jmp chk_r2r3                ;Send it as such.
;
;
itis_mdd:                               ;Validate a MDD.
;
;
            mov r7,#h'ff
            mov r6,#h'00                ;Same banana as above, but testing MD.
;
test_mds:   jnt0 loop_mdd               ;Using a greater time K.
            inc r6
loop_mdd:   mov r5,#h'ff
jst_wait:   djnz r5, jst_wait
            djnz r7, test_mds
;
            mov a, r6
            anl a,#h'80
```

-continued

Galaxy Series Target Hit/Auto Player Change - Vers. 2.20 Rev B.
Copyright 1992 C. A. Robinson & Co. Inc.
All rights reserved.

```
            jnz dead_duk
;
            mov r4,#h'03
            jmp send_duk
;
dead_duk:   jmp read_all
;
;
chk_r2r3:                                   ;Calculate pointer value into c. tbl.
;
;
            mov a, r4                       ;
;
            jb0 end_chck                    ;Test first bit.
            inc r3                          ;Increment row counter (table pointer).
            jb1 end_chck                    ;Test second bit.
            inc r3                          ;Increment, etc.
            jb2 end_chck                    ;And so on . . .
            inc r3
            jb3 end_chck
            inc r3
            jb4 end_chck
            inc r3
            jb5 end_chck
            inc r3
            jb6 end_chck                    ;Naturally it is the next bit.
            inc r3                          ;So, set the pointer accordingly.
;
end_chck:   mov a, r3                       ;Retrieve column counter for Port 1.
            movp3 a,@a                      ;Retrieve the content from the table.
            orl a, r7
;
;
xmit_val:
;
;
            mov r4, a                       ;
send_duk:   mov r7,#d'08                    ;Load Reg. 7 with number of bit to xmit.
;
syna_zro:   in a, p1                        ;Sync clock.
            jb4 syna_one
            jmp syna_zro
syna_one:   in a, p1
            jb4 syna_one
;
            mov a,#h'f7                     ;This is the start bit (bit 3 = 0).
            outl p1, a                      ;Send the sucker.
;
synb_zro:   in a, p1                        ;Sync again.
            jb4 synb_one
            jmp synb_zro
synb_one:   in a, p1
            jb4 synb_one
;
            mov a, r4                       ;Otherwise it is time, so byte.
            orl a,#h'f7                     ;Remember to keep bits 4 and 7 High.
            outl p1, a                      ;Send the little @#$%, (bit).
            mov a, r4                       ;Retrieve byte again.
            rr a                            ;Rotate to the right so to get next.
            mov r4, a                       ;Save it.
            djnz r7, synb_zro               ;Check for all 8 bits sent.
;
sync_zro:   in a, p1                        ;Sync for the last time.
            jb4 sync_one
            jmp sync_zro
sync_one:   in a, p1
            jb4 sync_one
;
;
pls_wait:                                   ;After xmit turn LED on.
;
;
            mov a, #h'ff
            outl p2, a                      ;Reset port 2.
            mov a, #h'7f
            outl p1, a                      ;Set port 1 (LED on).
;
            call updt_apc
            jmp read_all
```

-continued

Galaxy Series Target Hit/Auto Player Change - Vers. 2.20 Rev B.
Copyright 1992 C. A. Robinson & Co. Inc.
All rights reserved.

```
;
chnge_pl:   call push_ent
            jmp read_all
;
;
            .org h'100
;
;
;
updt_apc:   dec r0
            mov a, r0
;
            jnz noapc_yt
;
;           EXECUTE SPEECH SYNT. FUNCTION
;           MESSAGE #1 (at 00000 Hex.)
;           SAY (1), 'Please remove your darts now'
;
auto_apc:   mov r0,#h'03
;
            mov r7,#h'05
aul_loop:   mov r6,#h'ff
aln_loop:   mov r5,#h'ff
ast_loop:   djnz r5, ast_loop
            djnz r6, aln_loop
            djnz r7, aul_loop
;
            mov a,#b'01011111
            outl p1, a
;
            mov r7,#h'ff
bln_loop:   mov r6,#h'ff
bst_loop:   djnz r6, bst_loop
            djnz r7, bln_loop
;
            mov a, #h'ff
            outl p1, a
;
            mov r7,#h'0a
cul_loop:   mov r6,#h'ff
cln_loop:   mov r5,#h'ff
cst_loop:   djnz r5, cst_loop
            djnz r6, cln_loop
            djnz r7, cul_loop
;
;           EXECUTE SPEECH SYNTH. FUNCTION
;           MESSAGE #2 (at 0A000 Hex.)
;           SAY (2), 'Please trow darts now'
;
            ret
;
noapc_yt:   mov r7,#h'ff
dln_loop:   mov r6,#h'ff
dst_loop    djnz r6, dst_loop
            djnz r7, dln_loop
;
            mov a,#h'ff
            outl p1, a
            ret
;
push_ent:   mov r0,#h'03
;
swt_loop:   mov a,#b'01011111
            outl p1, a
;
            jni swt_loop
;
            mov a,#h'ff
            outl p1, a
;
;           EXECUTE SPEECH SYNTH. FUNCTION
;           MESSAGE #1 (at 00000 Hex.)
;           SAY (1), 'Please remove your darts now'
;
            mov r7,#h'ff
enl_loop:   mov r6,#h'ff
est_loop:   djnz r6, est_loop
            djnz r7, enl_loop
;
```

-continued

```
Galaxy Series Target Hit/Auto Player Change - Vers. 2.20 Rev B.
Copyright 1992 C. A. Robinson & Co. Inc.
All rights reserved.

        ret
;
;
;
        .org h'300
;
;
look_upt:
;
;
  .db 160,152,144,136,2,249,241,233,128,120,112,104,34,26,18,10,96,88,80
  .db 72,66,58,50,42,64,66,48,40,98,90,82,74,32,24,16,8,108,130,122,114,106,255
  .db 255,155,155,146,138,255,255,224,216,208,200,225,217,209,201,1,248,240
  .db 232,193,185,177,169,33,25,17,9,161,153,145,137,192,184,176,168,129,121
  .db 113,105,65,57,49,41,97,89,81,73,255,255,255,255,255,255,255,255,255,255
```

Many modifications and variations of the present invention are possible in light of the above teachings. Thus, it is be understood that, within the scope of the appended claims, the invention may be practiced otherwise than as described hereinabove.

What is claimed and desired to be secured by Letters Patent is:

1. In a dart game having a dart head with a plurality of scoring segments each actuatable by an impact thereon including a dart hit impact and a non-dart hit impact, a controller comprising:

means for determining the occurrence of an event representing the actuation of a scoring segment; and dart hit discrimination means responsive to said scoring segment actuation event determination for determining whether said actuated scoring segment was actuated by a dart hit impact or a non-dart hit impact.

2. In a dart game having a head with a plurality of scoring segments each actuatable by an impact thereon including a dart hit impact and a non-dart hit impact, a controller comprising:

means for determining the occurrence of an event representing the actuation of a scoring segment; and dart hit discrimination means responsive to said scoring segment actuation event determination of determining whether said actuated scoring segment was actuated by a dart hit impact or a non-dart hit impact, said dart hit discrimination means including means for determining whether the actuated scoring segment remains actuated for a predetermined period of time and if so said dart hit discrimination means determines that said scoring segment was actuated by a non-dart hit impact.

3. A dart game as recited in claim 2 wherein said predetermined period of time is not greater than 300 msec.

4. In a dart game having a dart head with a plurality of scoring segments each actuatable by an impact thereon including a dart hit impact and a non-dart hit impact, a controller comprising:

means for determining the occurrence of an event representing the actuation of a scoring segment;

dart hit discrimination means responsive to said scoring segment actuation event determination for determining whether said actuated scoring segment was actuated by a dart hit impact or a non-dart hit impact; and means responsive to said dart hit discrimination means for distinguishing between a dart hit actuated scoring segment and a non-dart hit actuated scoring segment.

5. In a dart game having a dart head with a plurality of scoring segments each actuatable by an impact thereon including a dart hit impact and a non-dart hit impact, a controller comprising:

means for determining the occurrence of an event representing the actuation of a scoring segment;

dart hit discrimination means responsive to said scoring segment actuation event determination for determining whether said actuated scoring segment was actuated by a dart hit impact or a non-dart hit impact, said dart hit discrimination means including means for determining whether the actuated scoring segment remains actuated for a predetermined period of time and if so said dart hit discrimination means determines that said scoring segment was actuated by a non-dart hit impact; and means responsive to said dart hit discrimination means for distinguishing between a dart hit actuated scoring segment and a non-dart hit actuated scoring segment.

6. A dart game as recited in claim 5 wherein said predetermined period of time is not greater than 300 msec.

7. In a dart game having a dart head with a plurality of scoring segments each actuatable by an impact thereon including a dart hit impact and a non-dart hit impact, a controller comprising:

means for determining the occurrence of an event representing the actuation of a scoring segment;

dart hit discrimination means responsive to said scoring segment actuation event determination for determining whether said actuated scoring segment was actuated by a dart hit impact or a non-dart hit impact; and software means for determining the occurrence of a predetermined number of dart hit impacts to automatically generate a signal that the player has changed.

8. In a dart game having a dart head with a plurality of scoring segments each actuatable by an impact thereon including a dart hit impact and a non-dart hit impact, a controller comprising:

means for determining the occurrence of an event representing the actuation of a scoring segment;

dart hit discrimination means responsive to said scoring segment actuation event determination for determining whether said actuated scoring segment was actuated by a dart hit impact or a non-hit dart impact, said dart hit discrimination means including means for determining whether the actuated scoring segment remains actuated for a predetermined period of time and if so said dart hit discrimination means determines that said scoring segment was actuated by a non-dart hit impact; and software means for determining the occurrence of a predetermined number of dart hit impacts to automatically generate a signal that the player has changed.

9. A dart game as recited in claim 8 wherein said predetermined period of time is not greater than 300 msec.

10. In a dart game having a dart head with a plurality of scoring segments each actuatable by an impact thereon including a dart hit impact and a non-dart hit impact, and said dart head having a missed dart detection apparatus associated therewith and actuatable by vibration of said dart head, a controller comprising:

means for determining the occurrence of an event representing the actuation of a scoring segment;

dart hit discrimination means responsive to said scoring segment actuation event determination for determining whether said actuated scoring segment was actuated by a dart hit impact or a non-dart hit impact;

means for determining the occurrence of an event representing the actuation of said missed dart detection apparatus;

missed dart discrimination means responsive to a missed dart event for determining whether said missed dart detection apparatus is malfunctioning;

means for determining the occurrence of a predetermined total number of dart hit impacts and missed darts detected by a non-malfunctioning missed dart detection apparatus to automatically generate a signal that the player has changed.

11. A dart game as recited in claim 10 wherein said dart hit discrimination means includes means for determining whether the actuated scoring segment remains actuated for a predetermined period of time and if so said dart hit discrimination means determines that said scoring segment was actuated by a non-dart hit impact.

12. A dart game as recited in claim 11 wherein said predetermined period of time is not greater than 300 msec.

* * * * *

UNITED STATES PATENT AND TRADEMARK OFFICE

CERTIFICATE OF CORRECTION

PATENT NO. : 5,366,230

DATED : November 22, 1994

INVENTOR(S) : Sanquinetti-Trigo

It is certified that error appears in the above-indentified patent and that said Letters Patent is hereby corrected as shown below:

Column 7, line 30, delete "j2" and insert --jz-- therefore.
Column 13, line 12, after 64, delete "66," and insert --eln-- therefore.
Column 13, line 12, after 8, delete "108,".
Column 13, line 13, after 255, delete "155,155," and insert --255,255,-- therefore.
Claim 2, column 13, line 46, delete "of" and isnert --for-- therefore.

Signed and Sealed this

Fourteenth Day of November, 1995

*Attest:*

Bruce Lehman

BRUCE LEHMAN

*Attesting Officer*

*Commissioner of Patents and Trademarks*